US005438923A

United States Patent [19]

Schoeps

[11] Patent Number: 5,438,923

[45] Date of Patent: Aug. 8, 1995

[54] METHOD AND APPARATUS FOR THE PREVENTION OF AEROSOL DEPOSITS IN A ROTARY PRINTING PRESS

[75] Inventor: Martin H. Schoeps, Güntersleben, Germany

[73] Assignee: Koenig & Bauer Aktiengesellschaft, Wurzburg, Germany

[21] Appl. No.: 186,336

[22] Filed: Jan. 25, 1994

[30] Foreign Application Priority Data

Jan. 25, 1993 [DE] Germany ..... 43 01 950.1

[51] Int. Cl.[6] ..... B41L 25/00

[52] U.S. Cl. ..... 101/147; 101/366; 101/425

[58] Field of Search ..... 101/147, 148, 423, 424, 101/425, 366

[56] References Cited

U.S. PATENT DOCUMENTS

| | | | |
|---|---|---|---|
| 2,856,848 | 10/1958 | Pritchard | 101/147 |
| 3,093,067 | 6/1963 | Huebner et al. . | |
| 3,139,028 | 6/1964 | Huebner et al. . | |
| 4,034,670 | 7/1977 | Zavodny | 101/148 |
| 4,044,674 | 8/1977 | Smith, Jr. | 101/148 |
| 4,143,596 | 3/1979 | Ivett | 101/148 |
| 4,393,778 | 7/1983 | Kaneko | 101/425 |
| 4,686,902 | 8/1987 | Allain et al. | 101/424 |
| 5,241,908 | 6/1992 | Tateishi | 101/425 |
| 5,299,495 | 4/1994 | Schoeps et al. | 101/425 |

FOREIGN PATENT DOCUMENTS

| | | | |
|---|---|---|---|
| 622359 | 12/1935 | Germany . | |
| 1761892 | 9/1971 | Germany . | |
| 2828454 | 1/1979 | Germany | 101/425 |
| 9216932 U | 1/1993 | Germany . | |
| 624948 | 1/1988 | Japan | 101/425 |
| 392326 | 5/1933 | United Kingdom | 101/425 |
| 968638 | 9/1964 | United Kingdom | 101/425 |

*Primary Examiner*—Ren Yan
*Attorney, Agent, or Firm*—Jones, Tullar & Cooper

[57] ABSTRACT

A device for preventing unwanted aerosol-like deposits on rotary printing presses utilizes an aerosol capturing assembly which is located adjacent a receptor roller. Any unwanted aerosol, which may be created adjacent the receptor roller by the operation of a droplet generating device, is removed by the aerosol capturing device.

5 Claims, 5 Drawing Sheets

METHOD AND APPARATUS FOR THE PREVENTION OF AEROSOL DEPOSITS IN A ROTARY PRINTING PRESS

FIELD OF THE INVENTION

The present invention is directed generally to a method and apparatus for the prevention of the deposit of an unwanted aerosol-like medium in a rotary printing press. More particularly, the present invention is directed to an apparatus for the removal of an aerosol in a dampening assembly of a rotary printing press. Most specifically, the present invention is directed to an apparatus for collecting and removing an unwanted aerosol of a dampening fluid or a dampening fluid and entrained particles from a receptor roller in a rotary printing press. The aerosol removal device is generally in the form of an elongated, generally planar aspirating duct which has an inlet slot that is located adjacent a contact line between two rollers. Any unwanted aerosol of dampening fluid or ink and possibly entrained contaminants is removed through the aspirating duct of the apparatus for prevention of aerosol deposits.

DESCRIPTION OF THE PRIOR ART

Dampening and moistening assemblies for use with rotary printing presses are generally well known in the art. In these devices, a dampening fluid, such as water, is typically applied to the surface of a suitable dampening fluid receiving roller by use of various spray nozzles, a brush roller, a centrifugal moistening fluid applicator or the like. In all of these devices, there may be an excess amount of dampening fluid used and this fluid is apt to form a spray or aerosol.

One generally known prior art moistening device is shown in U.S. Pat. No. 4,044,674. In this prior art device, moistening agents are applied by means of a spraying device to moistening agent rollers, which transfer the moistening agent to a plate cylinder by way of moisture application rollers. Spray nozzles, which are arranged in the axial direction of the moisture application rollers and above the moistening agent rollers, are shielded on both sides against the emitted moistening agent by spray shields that extend in the same direction.

A brush moistening device is shown in U.S. Pat. No. 4,143,596 and a centrifugal moistening device in U.S. Pat. No. 4,034,670. These devices are also used in applying a moistening agent to moistening agent rollers on a rotary printing press.

A limitation of these prior art devices lies in the fact that the moistening agent, which is sprayed against, or otherwise placed on one or a plurality of moistening agent rollers, floats in an uncontrolled manner around the print unit chamber in the form of an aerosol. In accordance with U.S. Pat. No. 4,044,674, the moistening agent emerges in the form of an aerosol from a gap between the jacket surface of the moistening agent rollers and the edges of the axially extending spray shields. This occurs in particular if the moistening agent emerges from the nozzle as a high-speed jet and the moistening agent rollers are provided with a smooth, rigid jacket surface. An aerosol emerging in this way is undesirable because, on the one hand, there is a loss of moistening agent, and on the other, the moistening agent emerging through the gap may already contain ink particles returned by the plate cylinder. These ink particles can collect in the vicinity of the nozzle outlet, which can bead to narrowing of the nozzle outlet and thus to changes in the spray cone of the emerging moistening agent which, in turn, results in irregularities in the application of the moistening agent.

It will thus be seen that a need exists for a method and apparatus for preventing the deposit of an unwanted aerosol-like medium in a rotary printing press. The apparatus for the prevention of aerosol deposits in accordance with the present invention provides such a device and is a significant improvement over the prior art devices.

SUMMARY OF THE INVENTION

It is an object of the present invention to provide a method and apparatus for the prevention of aerosol deposits in a rotary printing press.

Another object of the present invention is to provide an apparatus for the removal of an aerosol in a dampening assembly of a rotary printing press.

A further object of the present invention is to provide an apparatus for collecting and removing an unwanted aerosol of a dampening fluid in a rotary printing press.

Yet another object of the present invention is to provide an apparatus for using an aspirating duct for the removal of unwanted aerosol-like media.

Even still a further object of the present invention is to provide an apparatus for condensing a removed aerosol and for preventing the deposit of an aerosol and entrained particles in a rotary printing press.

As will be discussed in detail in the description of the preferred embodiments which is set forth subsequently, the apparatus for the prevention of aerosol deposits in a rotary printing press in accordance with the present invention utilizes an elongated aspirating duct to remove unwanted aerosols from the area adjacent a receptor roller in a dampening system for a rotary printing press. The aspirating duct has an elongated inlet slot which is placed adjacent the receptor roller. A spray of dampening fluid is placed on the receptor roller and the excess aerosol is removed by the aspirating duct. A leading edge of the inlet slot of the aspirating duct may be shifted toward or away from the surface of the receptor roller suitable cooling coils may also be used to condense the aspirated aerosol.

Various advantages are attained by the apparatus in accordance with the invention. By removing the unwanted moisture and/or ink particles in their volatile form, ink or moistening agent or cleaning fluid is recovered, depending on the type of use of the apparatus. In this way, unwanted ink particles, which cannot immediately be moved on by the transfer roller, are also removed, so that at least the cross section of the spray cone emerging through the nozzle outlet opening is not impaired. Furthermore, by preventing the unwanted deposit of finely dispersed particles on parts of the press, it is possible to omit corrosion-resistant covers for these press parts.

It will thus be seen that the apparatus for the prevention of aerosol deposits in a rotary printing press in accordance with the present invention overcomes the limitations of the prior art devices and is a substantial advance in the art.

BRIEF DESCRIPTION OF THE DRAWINGS

While the novel features of the apparatus for the prevention of aerosol deposits in a rotary printing press in accordance with the present invention are set forth with specificity in the appended claims, a full and complete understanding of the invention may be had by referring to the detailed description of the preferred embodiment, as presented subsequently, and as illustrated in the accompanying drawings, in which:

DETAILED DESCRIPTION OF THE PREFERRED EMBODIMENTS

Figure 1:
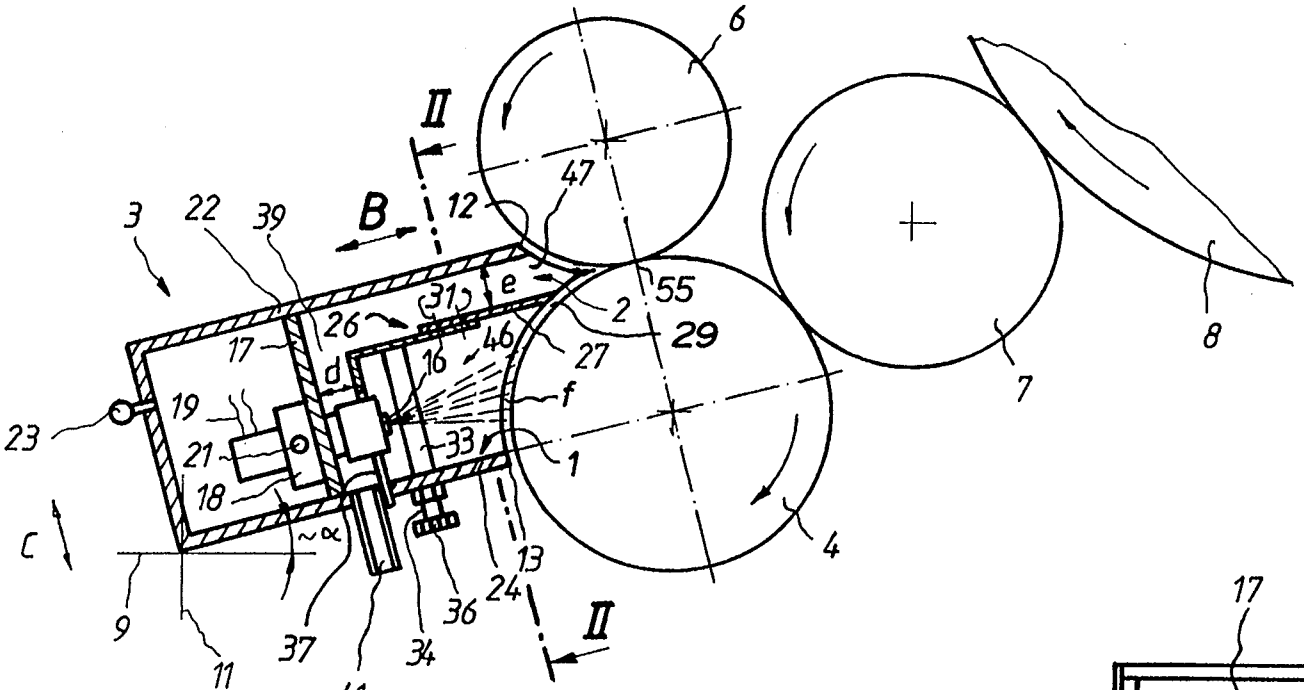
FIG. 1 is a schematic side view of a first preferred embodiment of a device for preventing aerosol deposits in accordance with the present invention.
Figure 2:
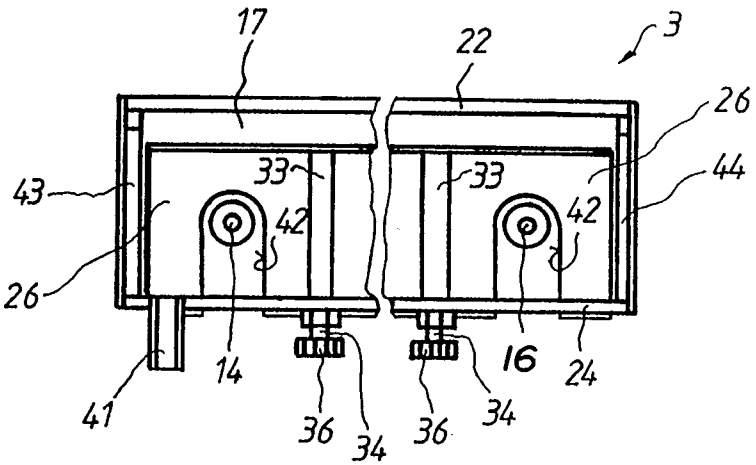
FIG. 2 is a cross-sectional view taken along the line II—II of FIG. 1.
Figure 3:
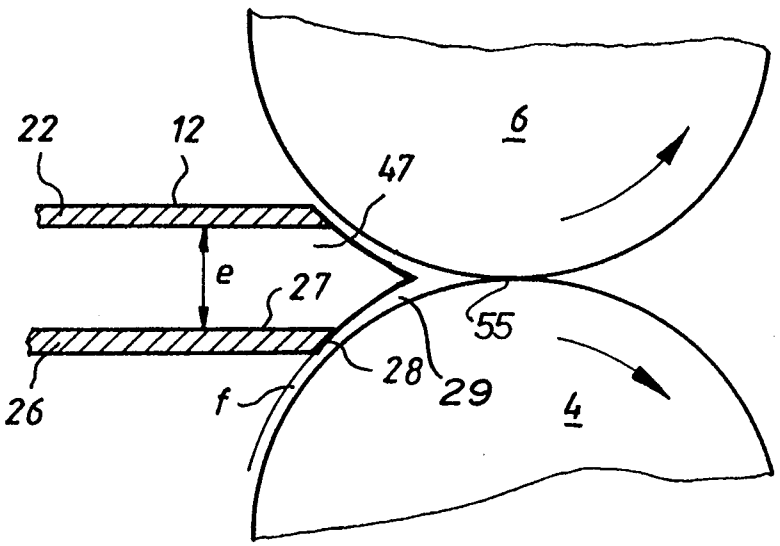
FIG. 3 is an enlarged illustration of a portion of the aerosol removal device positioned adjacent the cylinder gap.

Referring initially to FIG. 1 and taken in conjunction with FIGS. 2 and 3, a schematic side view of a first preferred embodiment of a device in accordance with the present invention may be seen. This first preferred embodiment consists of a transfer device or droplet generating device for a medium capable of forming droplets, indicated generally at 1 as a whole, and of a removal device or aerosol-capturing device for a medium capable of forming droplets, indicated generally at 2 as a whole. Both devices 1 and 2 are housed together in a housing 3 which is extending in the axial direction adjacent to two transfer rollers which are embodied as a receptor roller 4 and as a smoothing roller 6 which cooperates with receptor roller 4. The receptor roller 4 is in contact with a plate cylinder 8 through a further transfer roller 7. The devices 1 and 2 are arranged at an angle $\alpha$ which can be in the range of 3° to 90° with respect to a horizontal line. In this case, it is also possible to pivot the devices 1 and 2 around a perpendicular line 11 in the housing 3, so that it is also possible to supply a cylinder group, which is disposed mirror-reversed with respect to the perpendicular line 11, with a medium capable of forming droplets in a manner analogous to that of the rollers 4, 6 and 7 and the cylinder 8.

The housing 3 is approximately U-shaped in cross section, as seen in FIG. 1, and has upper and lower free edges 12 and 13, respectively, which are oriented toward a jacket surface of the smoothing roller 6 or the receptor roller 4. The distance of the free edges 12 and 13 of housing 3 to the rollers 6 and 4 is minimal and can lie in the range of between 0.5 to 25 mm. A plurality of nozzles 14 and 16 of the droplet generating device 1, which are preferably fan jet nozzles, are disposed in the axial direction, and are located in the lower or rear part of the housing 3. Only two nozzles 14 and 16 are shown in FIG. 2. The nozzles 14 and 16 are interlockingly fastened in a holder element 17 that is fixed in the housing 3. Holder 17 may, for example, be a strip of sheet metal extending in the axial direction. The spray nozzles 14 and 16 are each respectively connected with a magnet valve 18 for controlling the supply of a moistening agent. An electrical connection 19 is provided for each valve 18. The moistening agent supply takes place via a connector 21 on the magnet valve 18.

The upper, free edge 12 of the housing 3, which is extending in the axial direction with respect to the rollers 4 and 6, can be pivoted around a hinge 23 by means of its rearwardly extending upper housing part 22. After the upper housing part 22 has been pivoted forward, only the fastening element 17 with its supported nozzles 14 and 16, which is fastened on a lower housing part 24 of the housing 3, remains standing. The two devices 1 and 2 are housed in the front part of the housing 3 which is open in the direction facing toward the rollers 4 and 6. The droplet generating device 1 and the aerosol capturing device 2 are separated by a sheet metal guide plate 26 which is disposed parallel to the housing parts 22 and 24 and which extends in the axial direction of the rollers 4 and 6. An edge 28, extending in the axial direction in respect to the rollers 4 and 6, is formed at a first, free end 27 of the sheet metal guide plate 26 which is extending in the direction of the rollers 4 and 6. This edge 28 is disposed closely in front of the jacket surface of the receptor roller 4. For this purpose, the sheet metal guide plate 26 is displaceable in the direction B toward the rollers 4 and 6, so that the size of a gap "f" which, as seen most clearly in FIG. 3, is located between the edge 28 of the sheet metal guide plate 26 and the jacket surface of the receptor roller 4, can be adjusted to be approximately between 0.5 to 25 mm. For this purpose, the sheet metal guide plate 26 can be made of two parts which overlap each other, so that the end 27 of the plate 26 can be moved in the direction of the arrow B by the use of sketched-in screws 31 and cooperating elongated holes which are disposed on the upper part of the sheet metal guide plate 26.

The sheet metal guide plate 26 is held in an interlocked manner by supports 32 and 33 that are disposed on the lower housing part 24. The supports 32 and 33 can be adjusted in height in the direction indicated by arrow C in FIG. 1 by means of a threaded spindle 34 and a manipulator fastened thereon, which may, for example, be a knurled nut 36. In this way, the sheet metal guide plate 26 is simultaneously displaced in the direction of movement C. In the direction of its second end 37, the sheet metal guide plate 26 is angled in the direction of the lower housing part 24 and extends as far as the lower housing part 24. The sheet metal guide plate 26 is angled in such a way that its second end 37 extends at a distance "d" from the parallel extending fastening element 17. In this way, a conduit 39 for the removal device is formed, through which the removal of moisture and ink particles can take place. At the end of this conduit 39, one or a plurality of removal connectors 41 is disposed on the lower housing part 24 by means of which it is connected with a filter or cleaning device, not shown. In the vicinity of the nozzles 14 and 16, the sheet metal guide plate 26 has U-shaped recesses 42 as may be seen in FIG. 2, through which the spray heads of the nozzles 14 and 16 extend. The devices 1 and 2 are bounded at the front by suitable side shields 43 and 44, which are adapted to the shape of the rollers 4 and 6.

The droplet generating device i is disposed in the housing 3, with respect to the rollers 4 and 6 in such a way that a spray jet 46 of the nozzles 14 and 16 is directed on the jacket surface of the receptor roller 4. An opening 47 of the aerosol capturing device 2, which is directed towards the rollers 4 and 6, as seen in FIG. 3 is aimed toward a contact line 55 between the receptor roller 4 and the smoothing roller 6 over their entire length. The opening 47 has a height clearance "e",looking in cross section, as is seen most clearly in FIG. 3.

The apparatus for the prevention of aerosol deposits in a rotary printing press operates in the following manner. A moistening agent, for example, is applied by the nozzles 14 and 16 to the receptor roller 4, which is turning in a clockwise direction, and is moved on by the receptor roller 4 in the direction of the contact line 55 formed together with the smoothing roller 6 which moves in a counterclockwise direction. Aerosols, such as highly volatile fog-like particles, are created by the application of the moistening agent or ink to the receptor roller 4 and are carried along by the airflow circulating around the receptor roller 4 in the direction of rotation of the receptor roller 4. These aerosol particles which emerge behind the edge 28, are removed through the opening 47 of the aerosol capturing device 2 or aspirating duct. In this context the edge 28 of the first end 27 of the sheet metal guide plate 26 is used as a shear edge in a fluidic sense, so that the volatile aerosols are deflected behind the edge 28 and moved away. Because of the physical conditions, the air flows of the smoothing roller 6 and the receptor roller 4 are deflected in the roller gap 48 in the direction toward the aerosol capturing or removal device 2. In this way the highly volatile particles are removed by aspiration through the opening or elongated inlet slot 47. Because of this, particles of the moistening agent which had been previously unused are recovered. This also applies to the smoothing roller 6, which turns in a counterclockwise direction and also partially returns aerosols which now can be removed in a controlled manner. Furthermore, ink particles from the plate cylinder 8, which previously have floated around uncontrolled in the transfer device 1 and could be deposited in the vicinity of the nozzles 14 and 16, are returned by the transfer roller 7 to the receptor roller 4. These ink particles are now also aspirated off through the elongated inlet slot 47 of the aspirating duct of the aerosol capturing device 2 of the present invention.

The lower edge 28 of the first end 27 of the sheet metal guide plate 26 which except for a gap 29 having the spacing "f", is in the vicinity of the receptor roller 4, can have different cross sections. For example, edge 28 can be angled in the direction toward the upper housing part 22 or the lower housing part 24, or can be provided with sharp edges or rounded edges. The edge 28 can also be provided with a bead which may be circular in cross section and having a diameter corresponding to two to four times the material thickness of the end 27 of the sheet metal guide plate 26. The edge 28 can also be right-angled and embodied in a single thickness of material.

In place of the spray nozzles 14 and 16, it is also possible to employ a centrifugal moistening device or a brush moistening device for transferring moistening agents to a plate cylinder. Furthermore, it is possible by means of the device in accordance with the present invention to apply cleaning agents to ink application rollers, ink friction rollers, ink transfer rollers and rubber blanket cylinders. Beyond that, the employment of the device in accordance with the present invention is possible for applying ink to the rollers of an inking system.

Figure 4:
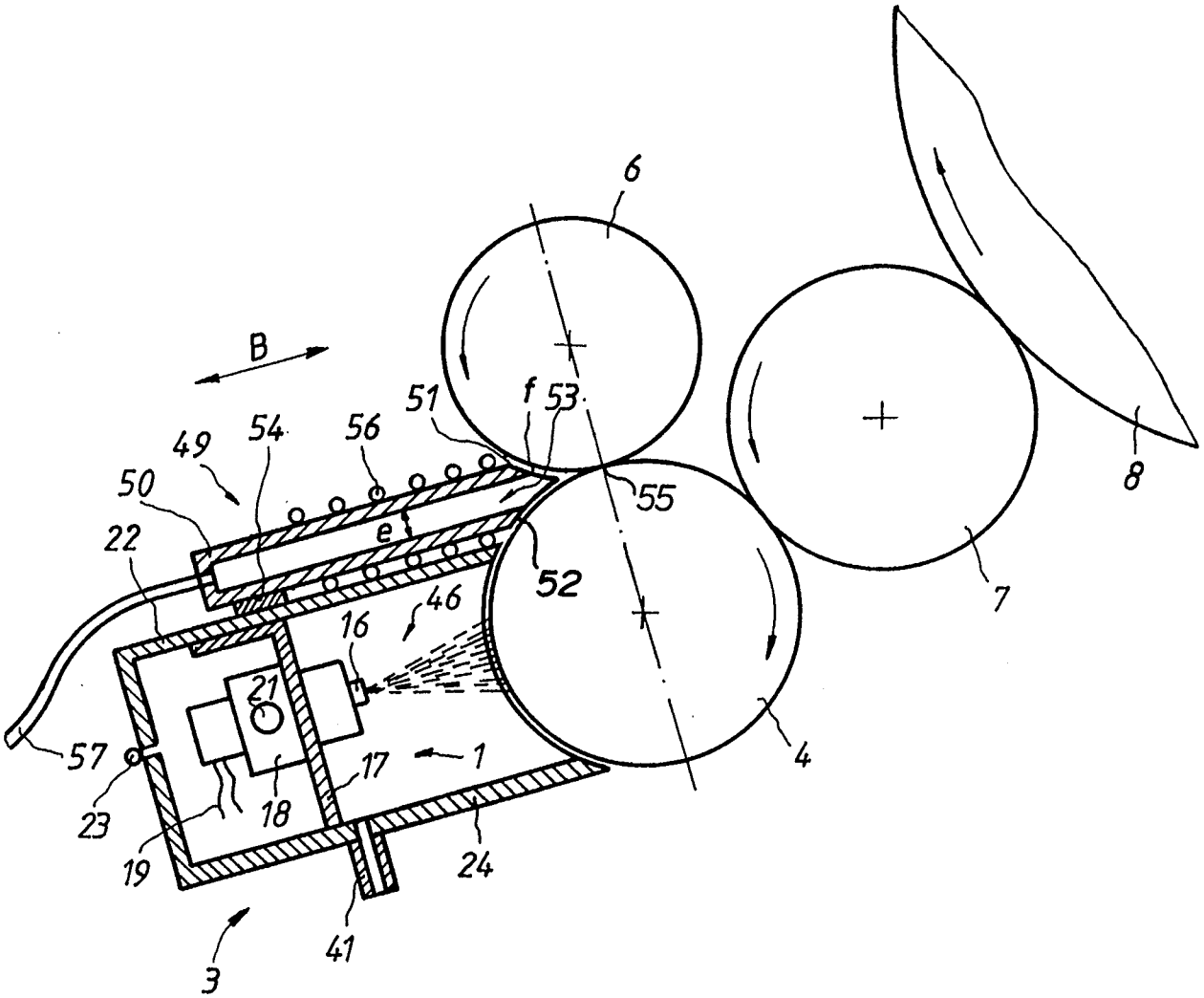
FIG. 4 is a schematic side view of a second preferred embodiment of the device for preventing aerosol deposits in accordance with the present invention.

A second preferred embodiment of a device for the prevention of aerosol deposits in accordance with the present invention is illustrated in FIG. 4. Here, only the transfer or droplet generating device 1 for media capable of forming droplets, for example in the form of a spray moistening device, is disposed in a housing 3. The housing 3 is composed of upper and lower housing parts 22 and 24, respectively, with the upper housing part 22 being pivotable by means of a hinge 23. A holder 17 is fixed on the upper housing 22, for receiving the nozzle 16 with the associated magnet valve 18. This holder 17 is angled off below the upper housing part 22 and is used as a support for the upper, pivoted housing part 22. An aerosol capturing or removal device, identified as a whole by 49, and having a housing 50, is placed on the upper housing part 22 and is disposed parallel with the transfer device 1. The aerosol capturing device 49 has a U-shaped profile in cross section, with the free edges 51 and 52 of the housing 50 being oriented in the direction to the jacket surface of the rollers 4, 6 and extending as far as the roller jacket surface, being separated therefrom by a gap 29. In the process for preventing aerosol deposits in accordance with the present invention, an opening 53 of the housing 50 of the removal device 49 is aimed at the roller gap 48 between the receptor roller 4 and the smoothing roller 6, so that preferably the upper, first edge 51 of the removal device 49 is brought adjacent to the vicinity of the jacket surface 6 and the lower, second edge 52 of the removal device 49 is brought near the jacket surface of the receptor roller 4. The opening or elongated inlet slot 53 also has a height "e". The end of the free edge 52 of the removal device 49 can be provided with another, different profile, as previously discussed with respect to edge 28.

The housing 50 of the removal device 49 is connected to the upper housing part 22 of the droplet generating or transfer device 1 in a frictional and interconnected manner by means of a dovetailed guide 54, which is depicted schematically in FIG. 4, so that the removal device 49 can be moved in the direction of the arrow B. A cooling device 56, indicated by cooling coils, can be placed within the housing 50 of the aerosol capturing or removal device 49, or, as shown in FIG. 4, can be placed on the outside of the housing 50, so that the removed particles can be caused to condense. The removal device 49 is provided with a discharge line 57 for the medium to be removed, which is removed by, for instance, suction. This is similar to the way in which a source of suction is applied to the removal connector 41 of the first embodiment to aspirate the aerosols through the capture device 2 shown in FIG. 1.

Figure 5:
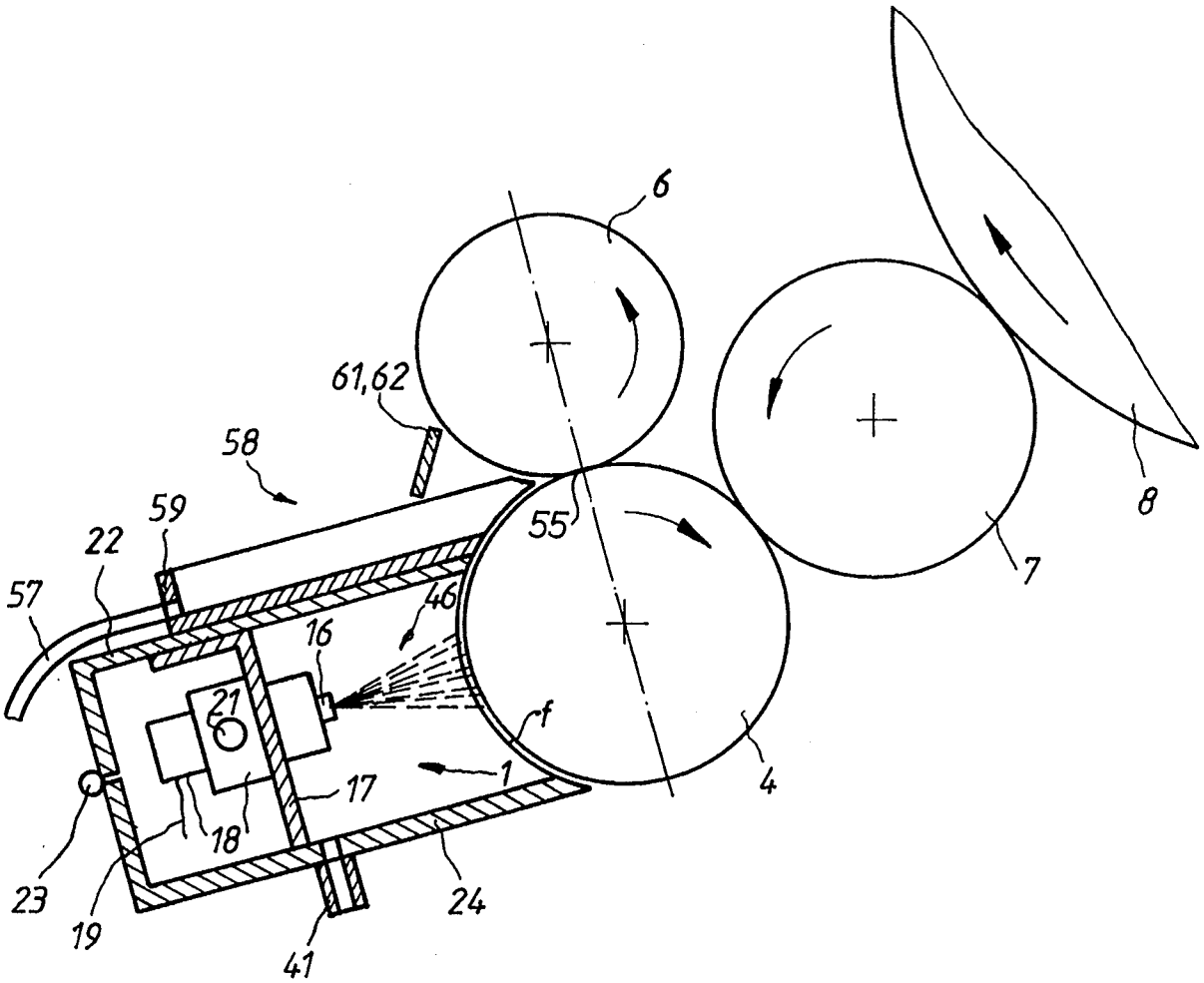
FIG. 5 is a schematic side view of a third preferred embodiment of a device in accordance with the present invention.

In accordance with a third preferred embodiment the present invention, as shown in FIG. 5, an aerosol capturing or removal device 58 is provided, and consists of a tub 59 which is disposed on the upper housing part 12 and which extends parallel to it, and above which one or a plurality of cooling devices 61 are disposed. The excess medium capable of forming droplets condenses on this cooling device 61 and drips into the tub 59 and is removed by the discharge line 57. Instead of the cooling device 61, it is also possible in this case to dispose an electrode 62 in the form of a metal plate and embodied as a cathode or an anode, on which the medium capable of forming droplets is deposited, provided a medium given a positive or negative electrical charge, for example a moistening agent, is discharged through the droplet generating or transfer device 1, for example through the nozzles 14 and 16.

Figure 6:
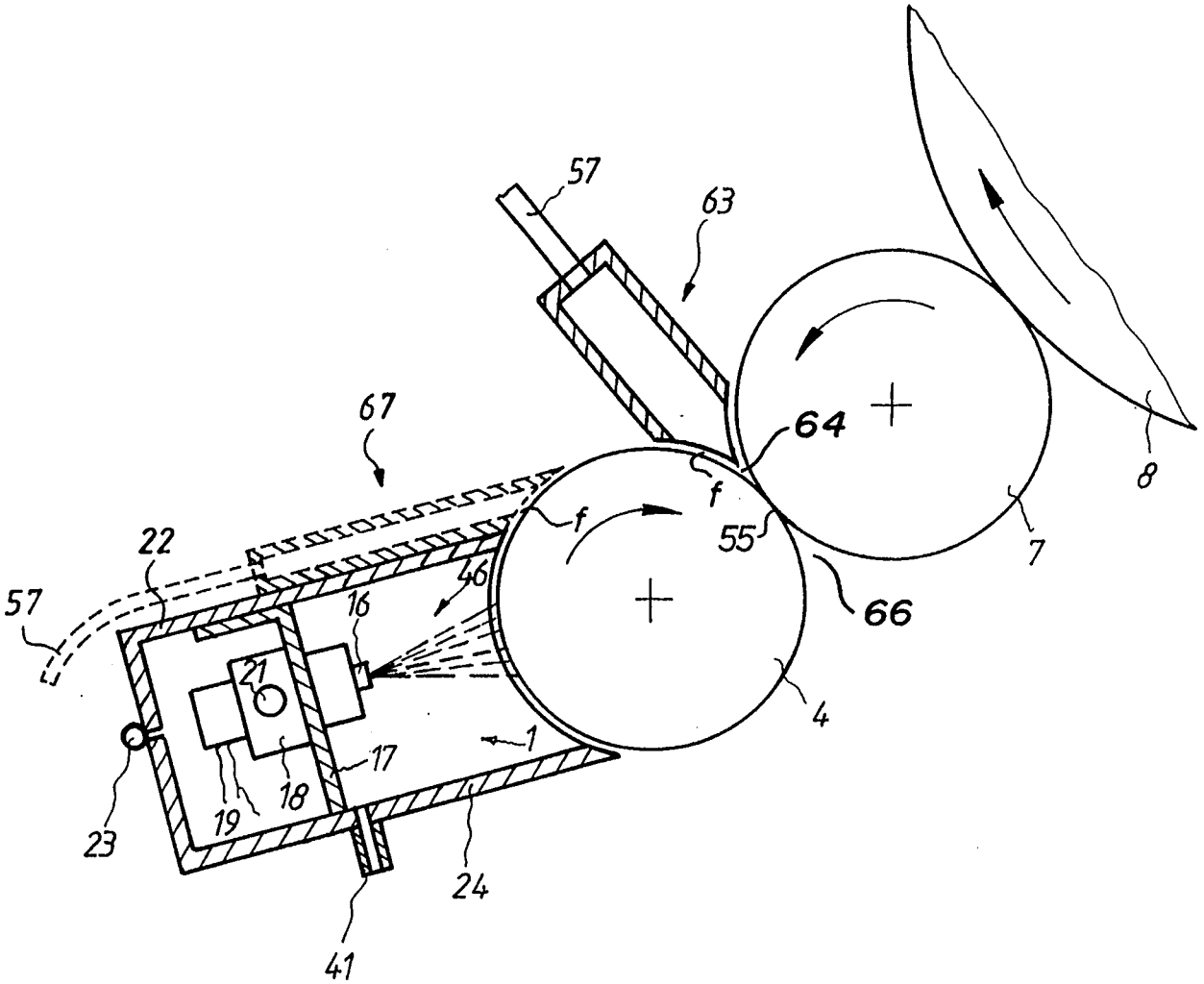
FIG. 6 is a schematic side view of a fourth and a fifth preferred embodiments of a device in accordance with the invention.

In a fourth preferred embodiment of the present invention, as shown in FIG. 6 a removal device 63 or aerosol capturing device which has a function analogous to that of the removal device 49 illustrated in FIG.

4, is provided. In this embodiment, the device 63 is disposed completely separated from the transfer or droplet generating device 1. Excess medium is drawn off from an inflowing roller gap 64 between the receptor roller 4 and the transfer roller 7. In this embodiment, the transfer device 1 is disposed before the roller gap 64, looking in the direction of rotation of the receptor roller 4. It would also be possible to dispose the removal device 63 in an outflowing roller gap 66 between the receptor roller 4 and the transfer roller 7.

A fifth preferred embodiment of the present invention is alternatively shown in FIG. 6 in dashed lines. A removal or aerosol capturing device 67 is disposed on an upper housing part 22 of a droplet generating device 1 which transfers moisture. The capturing or removal device 67 can be structured generally the same as the removal device 49 shown in FIG. 4, but with the special feature that no smoothing roller 6 is utilized. A discharge line 57 can again be connected with an aspirating device.

In the several embodiments of the apparatus for the prevention of aerosol deposits for the prevention of aerosol deposits in accordance with the present invention, the aerosol capturing or removal devices 49, 58, 63 and 67 are, as was the case with the aerosol capturing or removal device, generally at 2, all capable of operating as aerosol capturing and also as aerosol removal devices. The captured aerosol can be changed into droplet form by the cooling and condensing devices 56, 61 and 62 discussed previously, and then removed. The aerosols collected by these devices can also be removed by aspiration without being condensed. These spray aerosols can typically consist of ink, moistening agents or components of both. In all of the preferred embodiments of the present invention, the aerosol or mist capturing devices 2, 49, 58, 63 or 67 are disposed at a distance "f" from the circumference of the receptor roller 4 and, looking in the direction of rotation of the receptor roller 4, before or after a contact line 55 of the receptor roller 4 with another roller such as a smoothing roller 6 or a transfer roller 7. The smoothing roller 6 or the transfer roller 7 is located directly next to, and works with the receptor roller 4.

While preferred embodiments of an apparatus for the prevention of aerosol deposits in a rotary printing press, and the method of its use, have been set forth fully and completely hereinabove, it will be apparent to one of skill in the art that a number of changes in, for example, the length of the receptor roller, the source of aspirating suction, the number of droplet generating devices and the like can be made without departing from the true spirit and scope of the present invention which is accordingly to be limited only by the following claims.

I claim:

1. An aerosol capturing apparatus in combination with a rotary printing apparatus to capture stray aerosols generated in said rotary printing press by the impact of droplets formed by a droplet generating device and impacted against a receptor roller of said rotary printing press, said droplet generating device being positioned adjacent a circumferential surface of said receptor roller, said receptor roller cooperating with at least a first additional roller onto which it places a liquid coating applied to it by said droplet generating device, said receptor roller and said at least first additional roller engaging each other along an axially extending contact line, said aerosol capturing apparatus having an aerosol capturing inlet slot, said inlet slot being located adjacent, and extending along said contact line, said inlet slot being positioned to capture said stray aerosols.

2. The aerosol capturing apparatus in accordance with claim 1 including a housing for said droplet generating device and wherein said aerosol capturing apparatus includes a removal conduit connected to said housing and extending away from said contact line.

3. The aerosol capturing apparatus in accordance with claim 1 wherein said aerosol capturing apparatus includes an aerosol removal device having a captured aerosol cooling means.

4. The aerosol capturing apparatus in accordance with claim 1 wherein said aerosol capturing apparatus includes an electrode having a first charge, said electrode causing said stray aerosols which are provided with a second charge, opposite to said first charge, to condense thereon.

5. An aerosol capturing apparatus in combination with a rotary printing press comprising:

a first receptor roller supported in said rotary printing press for rotation about a first axis;

a droplet generating device usable to form droplets of liquid and to impact said droplets against said receptor roller for forming a liquid coating on said receptor roller and incidentally producing stray aerosols adjacent said receptor roller;

a second roller supported in said rotary printing press for rotation about a second axis parallel to said first axis and contacting said first receptor roller along a contact line parallel to said first and second axes and between said first and second rollers; and an aerosol removal device having an aerosol capturing inlet slot positioned adjacent said first and second rollers with said inlet slot adjacent, and extending along said contact line, said inlet slot being positioned to capture said stray aerosols whereby aerosol deposits on said rotary printing press are prevented.

* * * * *